United States Patent [19]

Lucas

[11] 4,229,914

[45] Oct. 28, 1980

[54] BUILDING STRUCTURES

[76] Inventor: Raymond D. Lucas, "Maryland", Old Mill La., Bray-on-Thames, Berkshire, England

[21] Appl. No.: 895,651

[22] Filed: Apr. 12, 1978

[30] Foreign Application Priority Data

Oct. 7, 1977 [GB] United Kingdom ..... 41873/77

[51] Int. Cl.[3] ..... E04B 1/347

[52] U.S. Cl. ..... 52/63; 52/86; 52/745; 135/4 R

[58] Field of Search ..... 52/63, 86, 745, 747; 135/1 R, 4 R

[56] References Cited

U.S. PATENT DOCUMENTS

| | | | |
|---|---|---|---|
| 3,028,872 | 4/1962 | Cresswell | 135/1 R |
| 3,534,511 | 10/1970 | Cappella | 52/63 |
| 3,564,784 | 2/1971 | Mollinger | 52/63 |
| 3,820,553 | 6/1974 | Huddle | 135/4 R |
| 4,028,861 | 6/1977 | Huddle | 52/63 X |
| 4,118,904 | 10/1978 | Sprung | 52/63 |

FOREIGN PATENT DOCUMENTS

| | | | |
|---|---|---|---|
| 2145502 | 3/1973 | Fed. Rep. of Germany | 52/63 |

*Primary Examiner*—Alfred C. Perham
*Attorney, Agent, or Firm*—Browdy and Neimark

[57] ABSTRACT

A readily erectable and/or demountable (and re-erectable) building structure comprising a plurality of arch frames in vertical planes extending transversely of and spaced apart longitudinally of the building structure, each frame being provided with retainer means retaining the longitudinal beaded edges of flexible strip roofing material. The retainer means are of groove-like or channel-like form to receive the longitudinal beaded edges slidingly therein. Preferably two strips are provided between each pair of neighbouring arch frames such that when in position they each extend across the space between the two arch frames of each pair with the strip's width and length dimensions directed respectively longitudinally and transversely of the building structure (and such that a gap is provided between the adjacent strip ends in the structure's roof), the strips being tensioned in the direction of their length dimensions (i.e. transversely of the building structure). Preferably each strip has a shape in its unstressed state such that when tensioned in the direction of its length dimension it adopts a configuration that is concave to the exterior of the building structure.

5 Claims, 9 Drawing Figures

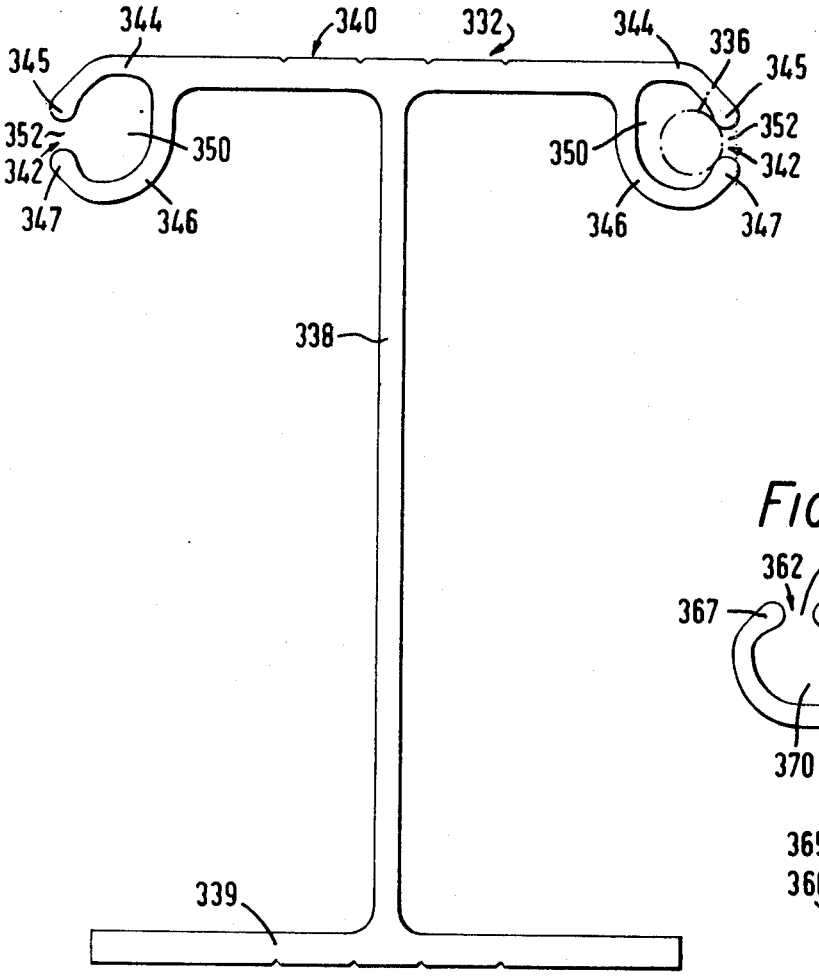
FIG. 4
FIG. 5
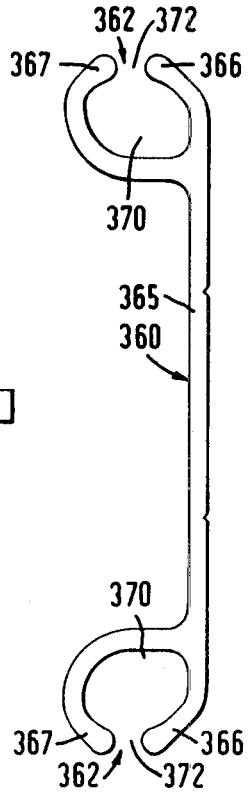

BUILDING STRUCTURES

This invention relates to building structures and in particular to so-called "demountable" or "portable" building structures that are readily assembled from a kit or set of components, to methods of assembling a building structure (e.g. from a kit or set of components), and to a kit or set of components for assembling or forming a building structure.

A known demountable building comprises a plurality of arch frames disposed in vertical planes extending transversely of the building and spaced apart longitudinally of the building, each arch frame being mounted on the ground or a ground support so as to be movable (during assembly) longitudinally of the building by adjustable spreader devices acting between pairs of neighbouring arch frames to spread apart further the two neighbouring arch frames of each pair and thereby tauten a single rectangular strip of flexible roofing material having its longitudinal edges releasably clamped or held between members associated with each of the two neighbouring arch frames, the tautening tension being directed longitudinally of the building and across the width of the strip.

According to a first aspect of this invention there is provided a building structure comprising a plurality of arch frames disposed in vertical planes extending transversely of the building structure and spaced apart longitudinally of the building structure, each frame being provided with retainer means for the longitudinal beaded edges of flexible strip roofing material, characterised in that the longitudinal beaded edges of two said strips are slidingly received in the retainer means of a pair of neighbouring frames such that the said two strips extend with their width dimensions directed longitudinally of the building structure across the space between the said pair of neighbouring frames and with their length dimensions directed transversely of the building structure in opposite directions, and in that the said two strips are tensioned in the direction of their length dimensions.

According to a second aspect of this invention there is provided a kit or set of components for forming a building structure, said components including: a plurality of frame members to form N arch frames to be disposed in vertical planes extending transversely of the intended building structure and spaced apart longitudinally of the intended building structure, 2(N−1) strips of flexible roofing material having beaded longitudinal edges, means to provide each arch frame with channel-like retainer means such that the longitudinal beaded edges of two said strips can be slidingly inserted into and along the retainer means of a pair of neighbouring arch frames to position the two strips with their width dimensions directed longitudinally of the building structure across the space between the arch frames of that pair and with their length dimensions directed transversely of the building structure in opposite directions, and tensioning means to tension the strips in the direction of their length dimension transversely of the building structure.

Preferably the arch frames (and/or the frame members to form them) are each of I-beam or T-beam cross-section having a flange supporting or integrally providing at least part of the retainer means as two continuous channels one each side of the beam's web and extending (and/or to extend) the length of the arch frame. Advantageously the arch frames (and/or the frame members to form them) are extrusions, e.g. of aluminium.

Preferably the lengths of the two strips (to be) provided between a pair of neighbouring arch frames are in aggregate less than that needed to extend continuously along an arch frame. Thus a gap can be formed in the roof of the building structure between the said two strips, this gap permitting air flow to and/or from the interior of the building structure, e.g. via air conditioning and/or ventilating equipment (for example mounted on the roof). If the structure is for use in environments subject to rain and/or snow, the gap(s) may be covered, e.g. by a roof-mounted superstructure comprising additional strips of flexible roofing material held taut between generally arcuate additional retainer means mounted on the arch frames.

According to a third aspect of this invention there is provided a method of assembling a building structure, said method including the steps of:

erecting a number of arch frames in vertical planes extending transversely of the intended building structure and spaced apart longitudinally of the intended building structure, two neighbouring arch frames being provided with retainer means for the beaded longitudinal edges of flexible strip roofing material;

sliding the longitudinal edges of two such strips into and along the retainer means of the two neighbouring arch frames such that the two strips are positioned across the space between said two neighbouring arch frames with the width dimensions of the strips directed longitudinally of the building structure and the length dimensions of the strips directed in opposite directions away from one another transversely of the building structure; and tensioning the said two strips in the direction of their length dimensions.

Preferably the adjacent ends of the two strips are secured to one another or to the arch frames, and the other ends of the two strips are secured to the arch frames or to ground. Said step(s) of securing may be performed before and/or during and/or after the tensioning step.

According to a fourth aspect of this invention there is provided a building structure comprising a number of arch frames in vertical planes extending transversely of the building structure and spaced apart longitudinally of the building structure, and a strip of flexible roofing material having longitudinal beaded edges is disposed between two neighbouring arch frames such that the strip is positioned across the space between the two arch frames with its width dimension directed longitudinally of the building structure and its length dimension directed transversely of the building structure, the building structure being characterised in that said two neighbouring arch frames are provided with channel-like retainer means that slidingly receive the longitudinal beaded edges of a said strip, in that the strip in said position is tensioned in the direction of its longitudinal dimension, and in that the strip in its unstressed state is shaped such that when tensioned as aforesaid it adopts a configuration that is concave to the exterior of the building structure.

According to a fifth aspect of this invention there is provided a kit or set of components for forming a building structure, the components including a plurality of frame members to form arch frames that, in the assembled building structure, are to be disposed in vertical planes extending transversely of the building structure and spaced apart longitudinally of the building structure, a strip of flexible roofing material having longitudinal beaded edges to be disposed in the assembled building structure between the two neighbouring arch frames such that said strip is positioned across the space between the two arch frames with its width dimension and longitudinal dimension directed respectively longitudinally and transversely of the assembled building structure, the components being characterised by means to provide said two arch frames with channel-like retainer means such that said strip's longitudinal beaded edges can be slidingly inserted into and along the channel-like retainer means, by tensioning means to tension the strip in said position in the direction of its longitudinal dimension, and by providing the strip, in its unstressed state, with a shape such that when tensioned as aforesaid by the tensioning means it adopts a configuration that is concave to the exterior of the building structure.

According to a sixth object of this invention there is provided a method of assembling a building structure, said method including the steps of: erecting a number of arch frames in vertical planes extending transversely of the intended building structure and spaced apart longitudinally of the intended building structure, two neighbouring arch frames being provided with retainer means for the beaded longitudinal edges of flexible strip roofing material; sliding the longitudinal edges of a said strip into and along the retainer means such that the strip is positioned across the space between the two arch frames with its width dimension and longitudinal dimension directed respectively longitudinally and transversely of the building structure; and, when positioned as aforesaid, tensioning the strip in the direction of its longitudinal dimension, the strip in its unstressed state having a shape such that when so tensioned it adopts a configuration that is concave to the exterior of the building structure.

By way of non-limiting example, embodiments of this invention will now be described with reference to the accompanying drawings of which:

FIG. 4 shows schematically a cross-section and/or a bottom end view of an arch frame for the building structure of FIG. 1 or FIG. 2;

FIG. 5 shows schematically a cross-section and/or an end view of retainer means inter alia for the end edges of flexible strip roofing material of the building structure of FIG. 1 or FIG. 2;

Figure 1:
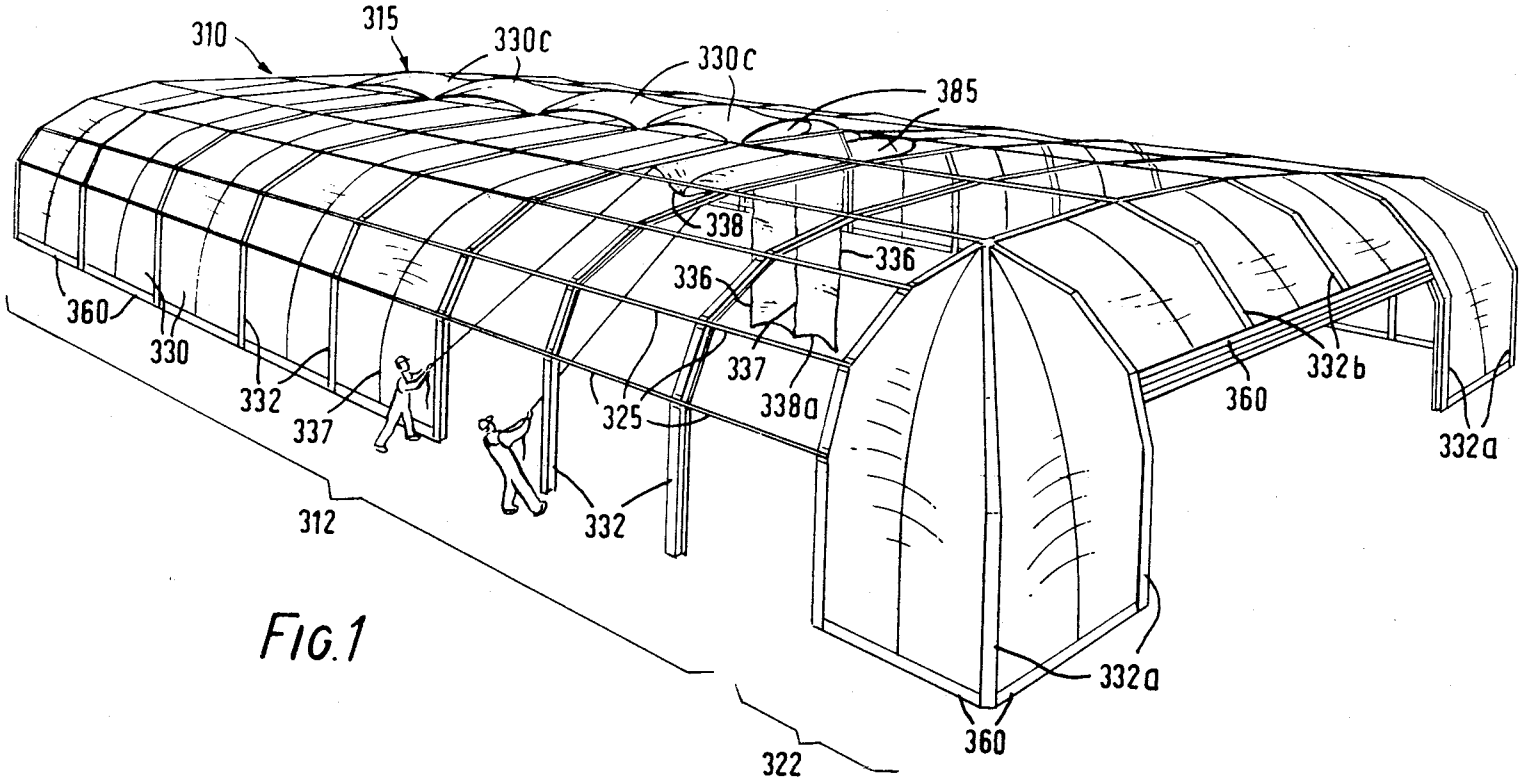
FIG. 1 is a perspective sketch of a building structure according to this invention during the course of assembly and erection.
Figure 2:
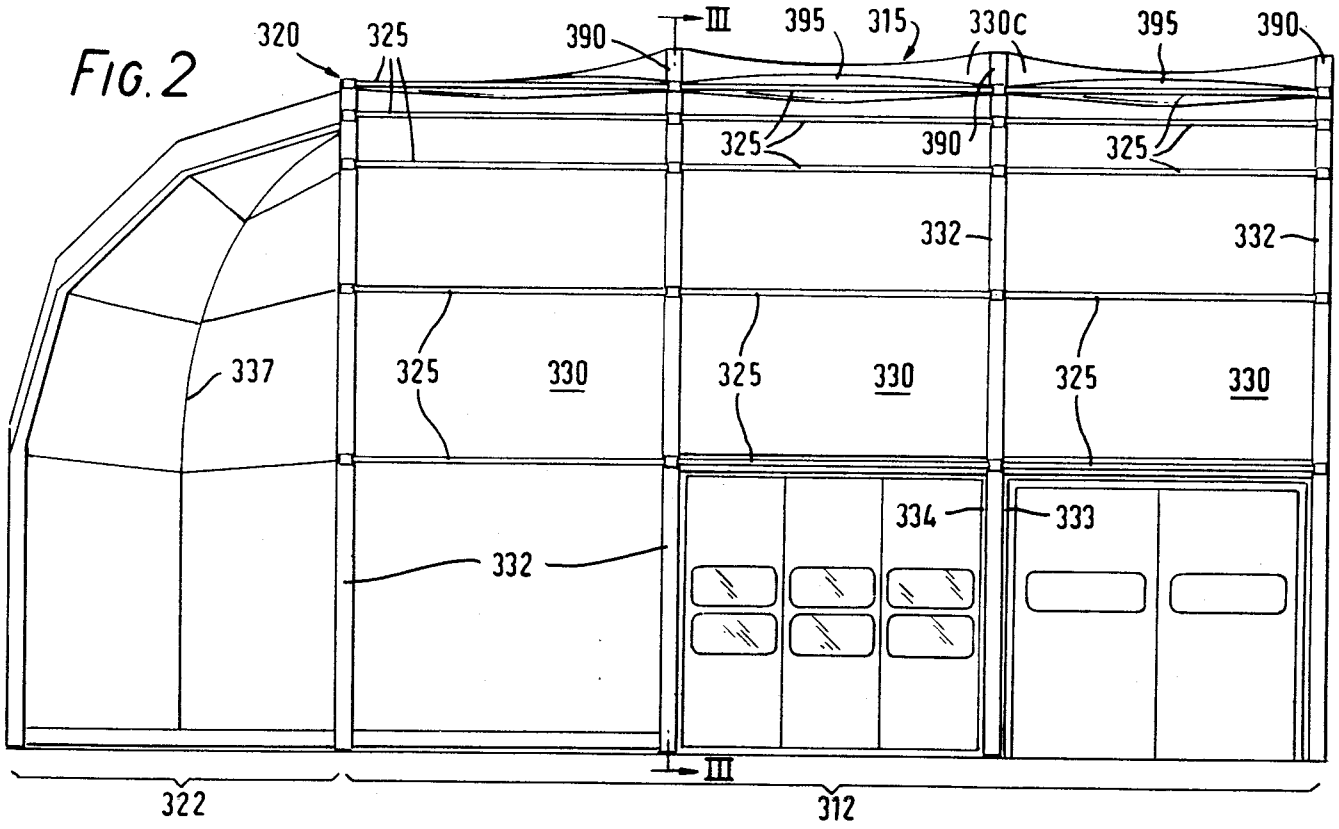
FIG. 2 is a diagrammatic side elevation of a completed building structure according to this invention that is similar to that of FIG. 1 but of lesser longitudinal length.
Figure 6A:
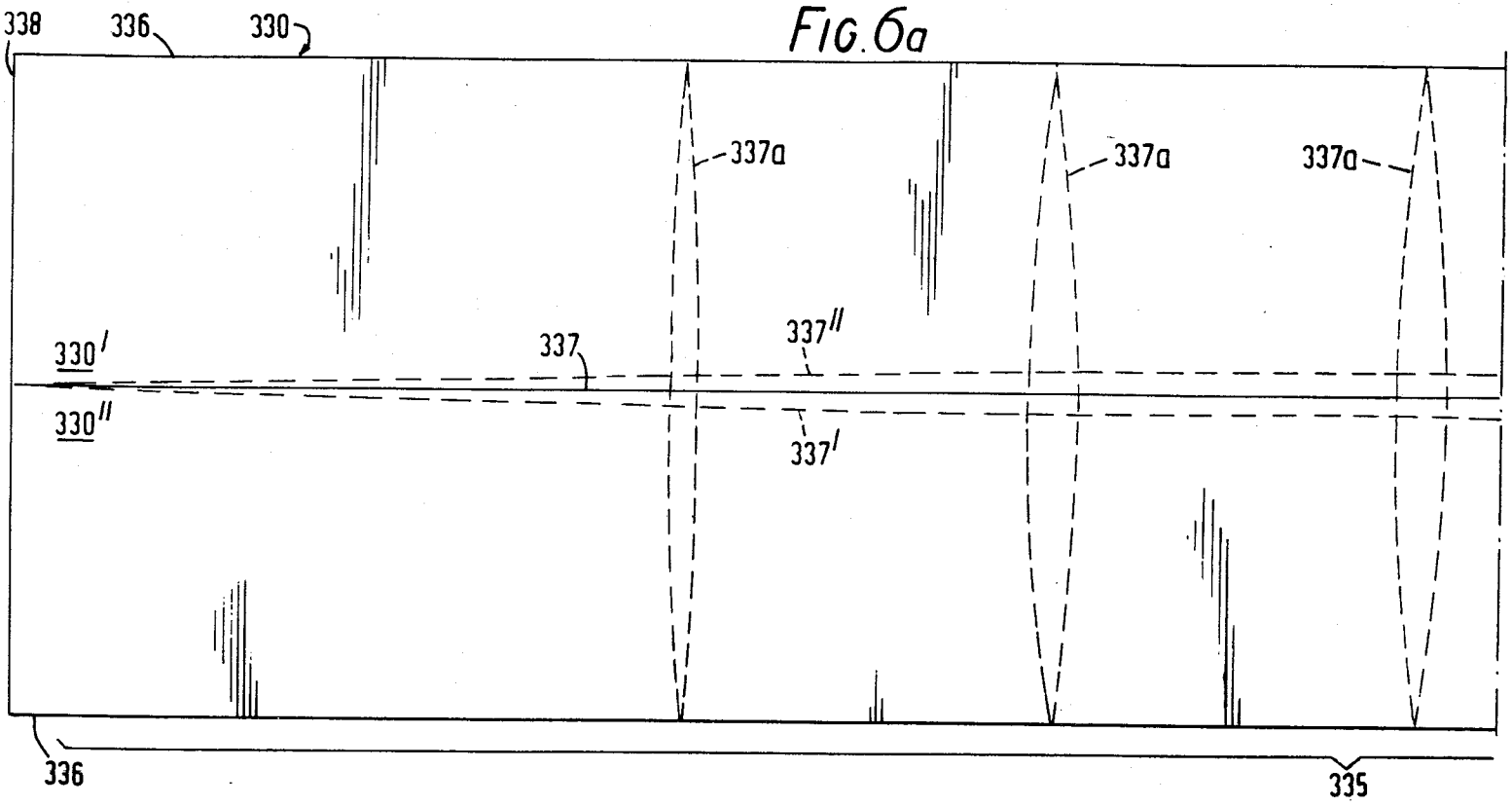
Figure 6B:
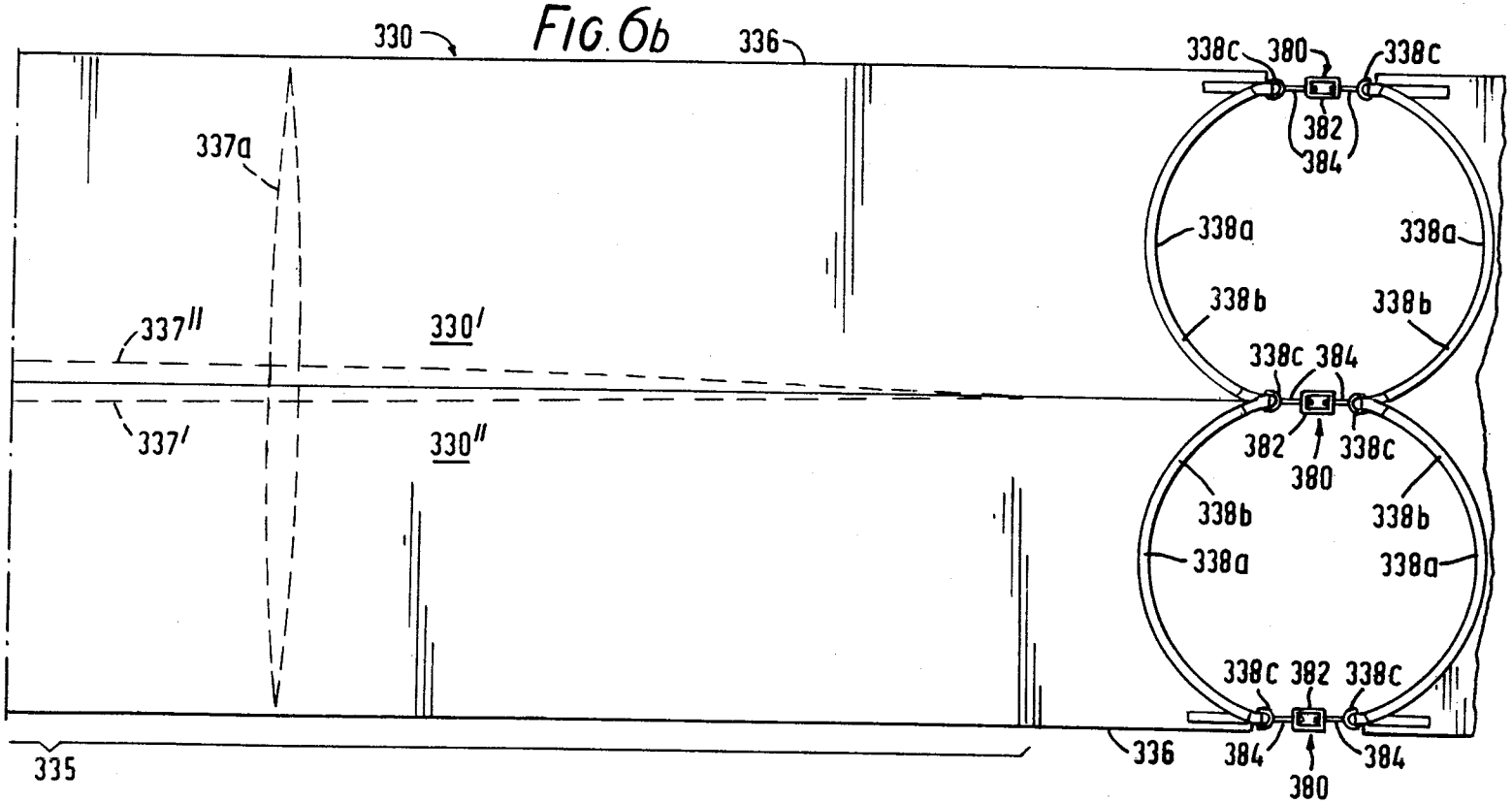
Figure 7:
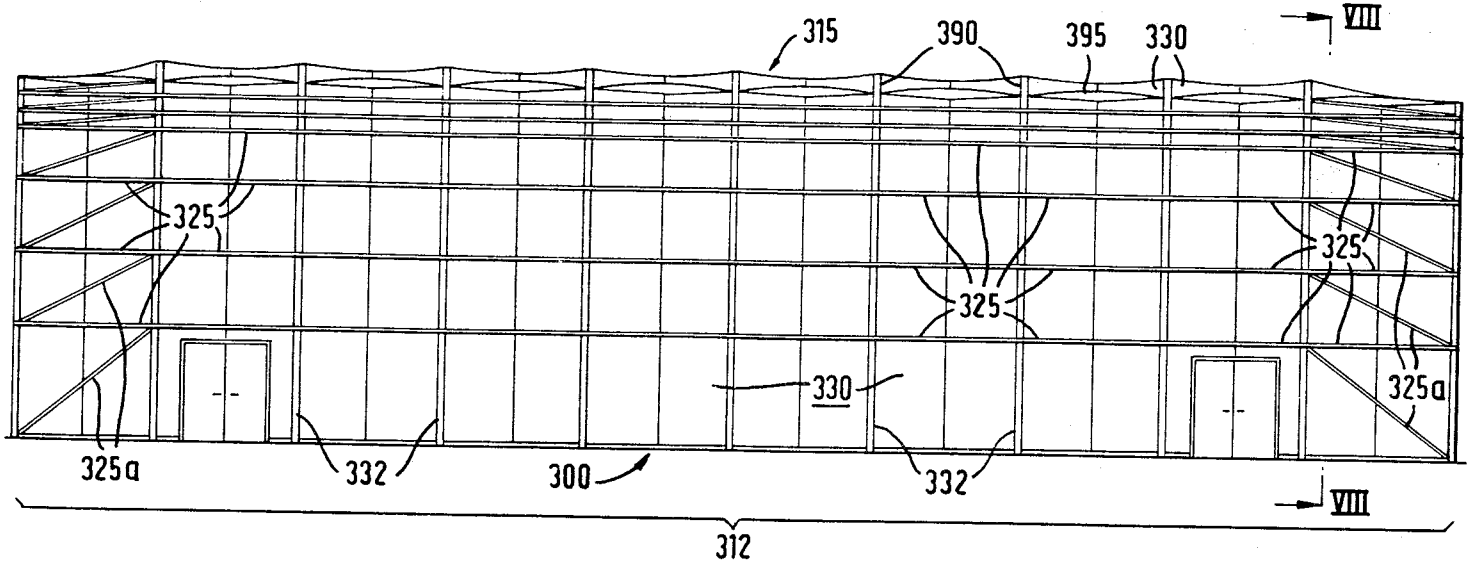
Figure 8:
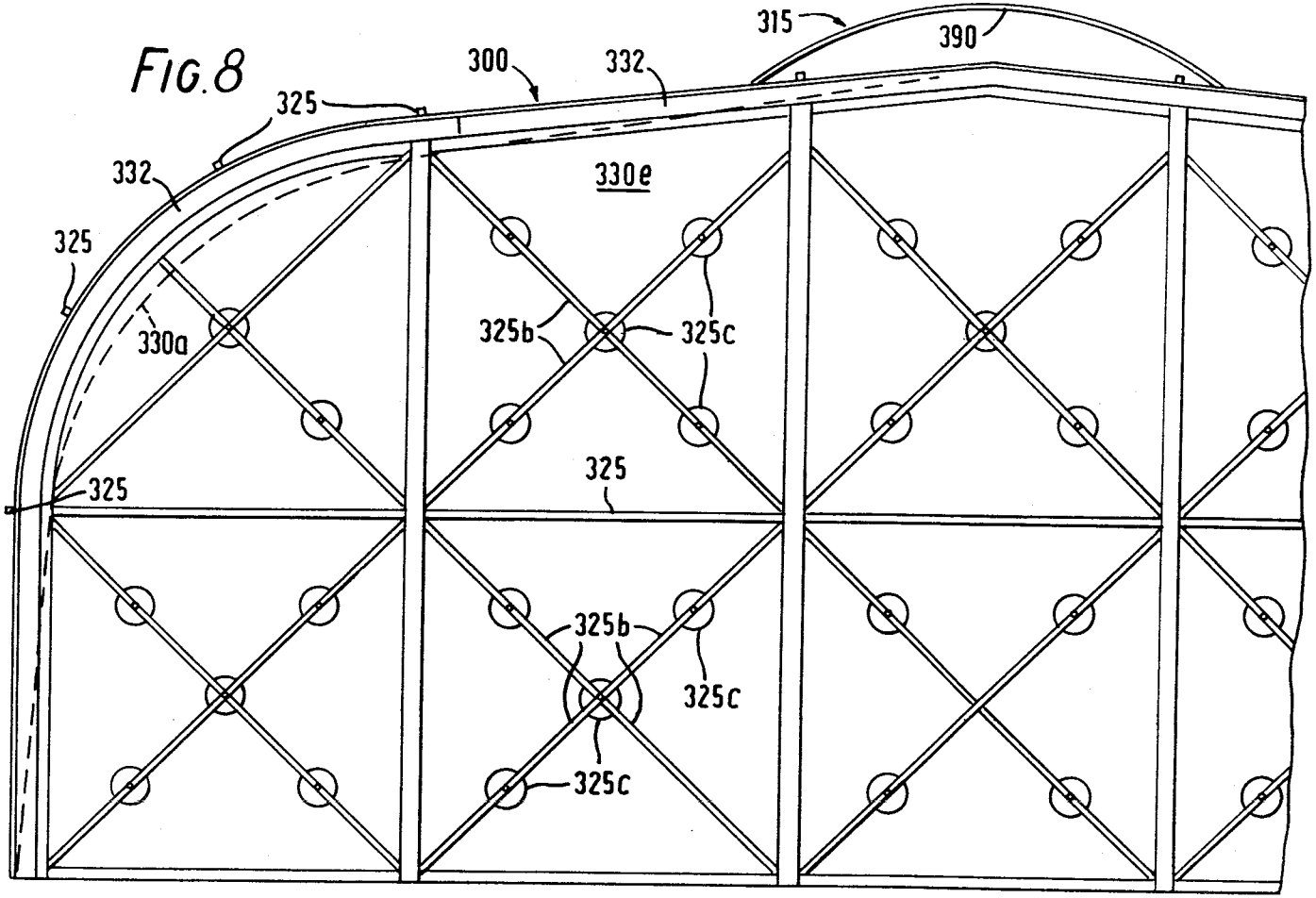

FIGS. 6*a* and 6*b*, when placed together side by side, represent a plan view of a shaped strip of flexible roofing material in the unstressed state for use in building the structure of FIG. 1 or 2, and FIG. 6*b* also shows schematically a form of tensioning device for use therewith;

FIG. 7 is a diagrammatic side elevation of another completed building structure according to this invention;

FIG. 8 is a diagrammatic cross-sectional view taken along the line VIII—VIII of FIG. 7.

Each of the three building structures of FIGS. 1, 2 and 7 is readily assembled and erected from a kit or set of components, and (after use) may be readily disassembled or demounted to provide a so-called "portable building" or "instant structure". Each of these three buildings 300, 310, 320 is rectangular in plan view and comprises a main section 312. Optionally, the building structure may also have an end section 322 at each or, as shown in FIGS. 1 and 2, at just one of its longitudinal ends. Each main section 312 comprises strip-like elements 330 of flexible roofing material (e.g. polyester fabric, preferably coated with pvc) stretched between extruded aluminium-alloy arch frames 332 that are disposed in vertical planes spaced apart longitudinally of the main section 312. In each of these illustrated embodiments, the spacing is fixed at a nominal 3 m by horizontal bracing struts 325 interconnecting neighbouring arch frames 332 to provide a rigid framework for the flexible elements 330.

Figures 3, 3A:
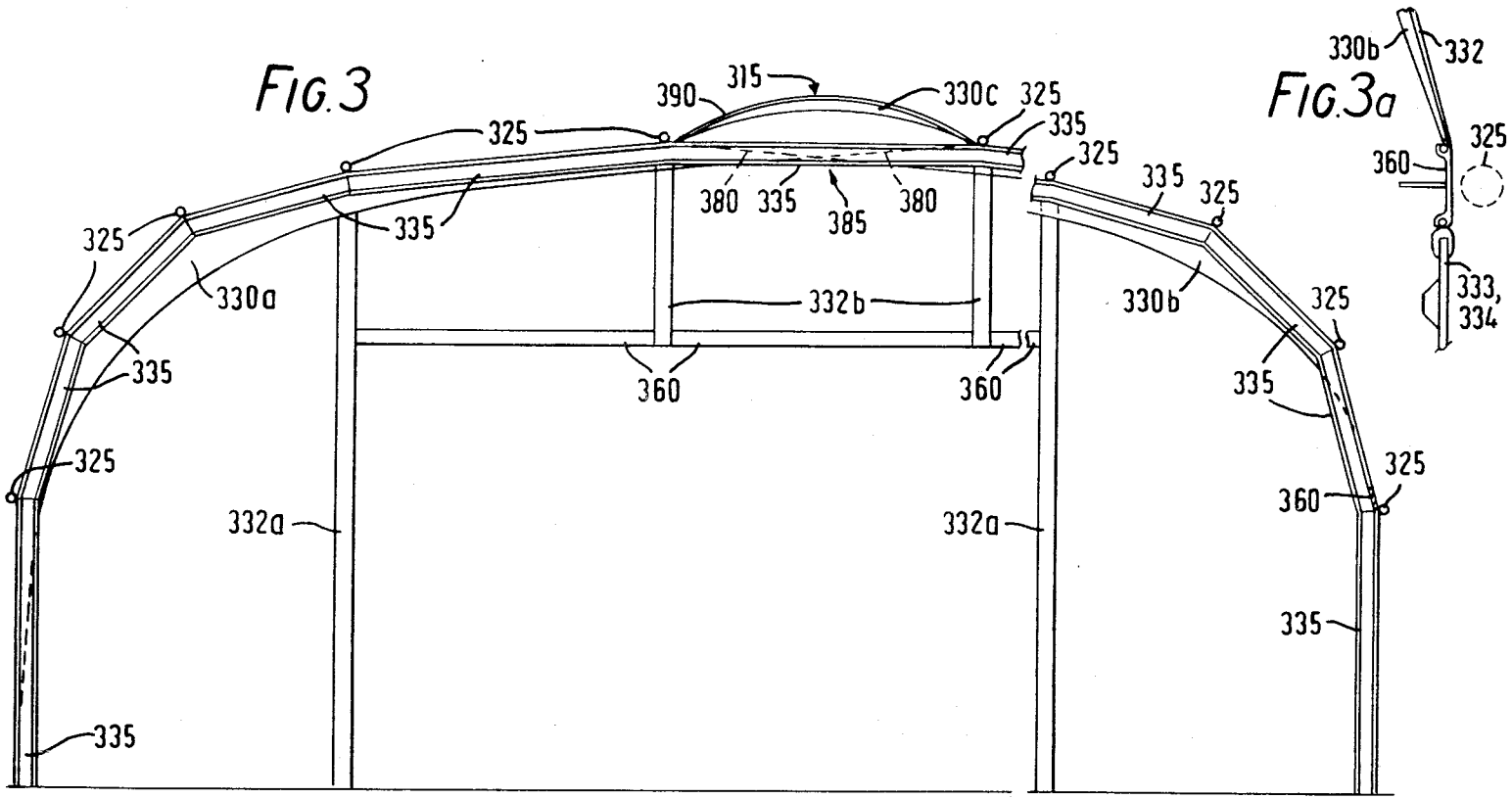
FIG. 3 is a diagrammatic cross-sectional view taken along the line III—III of FIG. 2.
FIG. 3*a* shows, enlarged, a detail of FIG. 3.

In the building structures of FIGS. 1 and 2 each arch frame 332 comprises a plurality of mutually inclined straight parts 335 of generally I-beam cross-section as shown in FIG. 4, the number of parts 335 and their length determining the building's width. Where the number of parts 335 is an even number, the arch frame has a pointed shape to provide a pointed roof-outline; and where the number of parts 335 is an odd number (eleven, as shown in FIG. 3), the arch frame has a flattened shape to provide a flat roof-outline. In either case the two end parts 335 of each arch frame are parallel to one another so as to stand vertically upright in fixed anchored ground positions, and have a height in the range 0.5 to 5 m (preferably 3 m). Adjacent parts 335 may be connected to one another by a splicing operation involving bolting one or more splicing plates to the web portions 338 and/or to the flange portions 339, 340 of the I-section parts across the join line between the parts; or the parts 335 may be integral with one another and formed from a single length of I-beam cross-section that has V-shaped cut-outs formed therein through the internal flange portion 339 and the web portion 338 so as to permit bending of the external flange portion 340 at the apex of each V to close the cut-out, the join lines being welded together and reinforced by one or more splicing plates bolted across them to the adjoining flange portions and/or web portions.

As shown in FIG. 4, the flange portion 340 of each I-section arch frame 332 is formed with an integral double-edge part 342 to each side of the web portion 338. Each double-edge part 342 has a portion 344 extending generally contiguously from the main body of flange portion 340, and also has a somewhat J-shaped portion 346 connected to portion 344 and adjacent the web portion 338. The edges 345 and 347 of portions 344 and 346 are directed towards one another such that each double-edge part 342 is of generally C-shaped cross-section providing a re-entrant continuous channel or groove 350 having a mouth or entrance 352 of smaller width than the width of the channel 350. When the arch frames 332 are fixed or anchored in position in their spaced apart vertical planes, the channels 350 of any two neighbouring arch frames have their open mouths 352 facing one another.

Two strips 330 (referenced 330*a* and 330*b* in FIG. 3) of the flexible roofing material are provided between each pair of neighbouring arch frames 332 to extend across the space between the two arch frames of the pair (under the bracing struts 325) with the width dimension of the two strips directed longitudinally of the building structure and with the length dimension of the two strips directed transversely of the building structure in opposite directions away from a region about the centre-line of the roof, i.e. one strip each side of the building structure (from adjacent the top towards the bottom). The length dimensions of the two strips are, in aggregate, less than that of an arch frame 332 along the latter from end-to-end so that a gap 385 is formed between the adjacent ends of the two strips in the vicinity of the said roof region (see FIG. 1). Each strip 330, in the unstressed state, has a bowed shape such that portions 335 of its longitudinal parallel edges 336 are further apart (as measured along the strip width). This bowed shape can be produced by forming the equivalent of sewn "darts" in the fabric material of an originally rectangular strip, the "dart" equivalents extending laterally and/or longitudinally of the strip as appropriate. Conveniently, each strip 330 can be formed of two elongate pieces 330' and 330'' welded together along adjacent side edges 337' and 337'' to form a central longitudinal "dart" 337, the side edges 337' and 337'' being bowed outwardly away from the other side edges—which form the parallel edges 336—so that the distance between the two edges 336 as measured along the width of the strip 330, is not constant throughout the strip length. For example, at distances of 1.5 m, 3 m, 3.8 m, 4.6 m, 5.4 m, 6.2 m, 7 m, 7.8 m, 9.3 m and 10.8 m from a straight end edge 338 of the strip 330, the distance between the latter's parallel edges 336 (as measured along the width of the strip) may be respectively 3.06 m, 3.14 m, 3.16 l m, 3.18 m, 3.20 m, 3.18 m, 3.15 m, 3.12 m, 3.08 m and 3.02 m. Also, in this example, lateral "darts" 337*a* may be provided across the width of the strip 330 at distances 3 m, 4.6 m, 6.2 m and 7.8 m from said straight end edge 338, these "darts" providing a dimensional change increasing from zero at each strip edge 336 to a dimensional change along the strip centre of respectively 10 cm, 20 cm, 20 cm and 10 cm.

Each bowed strip 330 has its four corners cut away, and has all four edges (or at least its two longitudinal edges 336 and its straight transverse edge 338 to be lowermost in the structure) provided with a beading in the form of a cord or rope within an edge hem, the latter being provided by folding a selvedge of the fabric around the cord or rope and welding or stitching that selvedge to the main body of the strip 330. At straight edge 338, a wider selvedge is provided and only a portion thereof is welded to the main body of the fabric, the remainder being folded back outwardly to provide a water drip strip to overlie a bottom edge retainer member. The strip edge 338*a* opposite edge 338 is epsilon-shaped and reinforced by a nylon belt 338*b* passing through three metal loops or links 338*c* forming eyelets.

To provide the two strips 330 between a pair of neighbouring arch frames 332 that are positionally fixed and anchored, the two opposite longitudinal beaded edges 336 of a first strip 330 are slid from one side into and along the two facing channels 350 of the two arch frames (see FIG. 1). The operation is then repeated with the second strip 330 from the other side and in the opposite direction. Each of the two strips 330 is thus in position with its longitudinal beaded edges 336 retained by the channel edges 345, 347 but is in a loose or non-taut condition. The straight beaded transverse edge 338 of each strip 330 is retained in position adjacent the ground by a retainer member 360 (FIG. 5) of extruded aluminium alloy. This retainer member 360 has a plate portion 365 provided integrally with two lateral double-edge parts 362 each of generally C-shaped cross-section similar to the double-edge parts 342 of the arch frames 330 and likewise each providing a re-entrant contiguous channel or groove 370 having a mouth or entrance 372 (of smaller width than the width of the channel 370) provided by edges 366, 367 directed towards one another. One channel 370 of a retainer member 360 is slid over and along the lowermost beaded transverse edge 338 of a strip 330 and the retainer member 360 then bolted to the foot portions of the two neighbouring arch frames 332 between which that strip 330 extends, the bolts extending through the retainer member's plate portion 365 and the arch frames' flange portion 340. The other channel 370 of the retainer member 360 may have mounted therein a sealing or weathering strip, conveniently of 8-shaped cross-section, to engage the ground.

Alternatively, the retainer member 360 may be an extruded aluminium alloy member of generally L-shaped cross-section, the vertical limb of the "L" being integrally formed with a re-entrant channel or groove 370 to retain the lower-most beaded transverse edge 338 of a strip 330 slidably inserted therein, and the horizontal limb of the "L" being anchored to the ground by anchor pins or bolts.

With the lowermost transverse beaded edge 338 and the two longitudinal beaded edges 336 of each strip 330 thus in position between a pair of neighbouring arch frames, the uppermost beaded edges of the two strips are interconnected via one or more (preferably three) tensioning devices 380 (as shown in FIG. 6) or are each connected via two or more tensioning devices 380 to the arch frames 332 at locations to the opposite side of the gap 385 (see FIG. 3). The or each tensioning device 380 preferably includes a turnbuckle 382 threadedly connected by opposite threads between threaded rods 384 of which one is coupled to the uppermost beaded edge 338*a* of one strip 330 (e.g. an eyelet 338*c*) and of which the other is coupled either to the uppermost beaded edge 338*a* of the other strip 330 (e.g. an eyelet 338*c*) or to said location, as the case may be. Alternatively, where the uppermost beaded edge 338*a* of a strip 330 is straight, coupling of a turnbuckle rod 384 thereto may be effected via another retainer member 360, somewhat shorter than that employed for the lowermost beaded strip edge 338. Rotation of the turnbuckle(s) 382 causes the uppermost edges of the two strips 330 to approach one another and, since their lowermost edges 338 are held by the retainer members 360, thereby tautens and tensions the two strips 330 in their longitudinal direction (i.e. transversely of the building structure). As the longitudinal tension in each strip 330 increases, a corresponding tendency arises for each strip to contract in its transverse width direction (i.e. longitudinally of the building). This tendency to contract in the strip width direction is enhanced by the particular predetermined shape of the strips 330 in their unstressed condition due to the outwardly-bowed configuration of the longitudinal edge portions 336, which portions correspond to the regions of greater curvature of the installed strips in the vertical plane (as viewed in FIG. 3). Due to this contraction tendency, and since the arch frames 332 are positionally fixed, the strips 330 are tautened and tensioned in the direction of their width dimension so that (as apparent from FIG. 3) at least the major part of each strip 330 has its surface deformed concavely to the building exterior. This concavity conveniently provides a rain drainage path away from the arch frames 332 to minimise any leakage past the strips' longitudinal edges 336.

It will be appreciated that the strips 330 are retained and held securely in their tautened and tensioned condition by virtue of their longitudinal beaded edges 336 engaging the mutually directed edges 345, 347 of the channels 350 internally of the channels 350 and of their lowermost transverse beaded edges 338 engaging the mutually directed edges 366, 367 of the channels 370 internally of the channels 370, the entrance or mouth 352, 372 of channels 350, 370 being too narrow for the strips' beaded edges to emerge therefrom.

It will be appreciated that the two strips 330 provided between a pair of neighbouring arch frames 332 need not be of equal length. Thus, where each of such strips extends downwardly to ground level, the gap 385 between their adjacent upper ends could be to one side of the roof's centre-line. Alternatively (and preferably), the gap 385 could be on the roof centre-line with one strip (330*a* in FIG. 3) extending downwardly to ground level and the other (330*b* in FIG. 3) terminating above ground level with its retainer member 360 attached at each end to an upper one of the parts 335 of each arch frame of the pair. The lower channel 370 of the retainer member 360 may then retain the upper edge of a door frame 333 or window frame 334 (see FIG. 2 and FIG. 3*a*) of which the longitudinal edges are slidingly received in the opposed channels 350 of the two arch frames 332.

Where provided, the or each end section 322 of the building structure is formed by providing further elements of like flexible roofing material having their side edges slidingly received in retaining channels 350 of "half-arch" frames 332*a* and "partial-arch" frames 332*b* which are connected at their upper ends to the appropriate end arch frame 332. The feet of the half-arch frames 332*a* are spaced apart and fixed or anchored at ground level with one of them in each actual corner of the rectangular plan outline of the complete building. This permits a maximisation of the available floor area being enclosed by the complete building structure. In the vicinity of each corner of end section 322 and to each side of the corner-disposed half-arch frame 332*a*, the said further roofing elements are of generally triangular shape dimensioned such that on tensioning them from apex to base (each of the latter being retained in the channel 370 of a further retainer member 360), a contraction tendency occurs between their sides so as to cause the roofing elements to tauten and be tensioned from side to side between neighbouring retaining channels 350. The apex to base tension may be applied via a further tensioning device such as a turnbuckle 382 connected between the apex and the end arch frame 332. Between these corners and along the transverse end of the completed building, the further roofing elements of the end section 322 may be of generally strip-like form, preferably shaped somewhat similarly to the flexible roofing element 330 shown in FIG. 6. The side edges of these further roofing strips are slidingly received in the channels 350 of the half-arch and/or partial-arch frames 332*a*, 332*b*, and their lower ends are slidingly received in the channels 370 of further retainer members 360 attached to and extending between neighbouring frames 332*a*, 332*b*. As best shown in FIG. 1, the further retainer members 360 of end section 322 that interconnect the partial-arch frames 332*b* are located above ground level to provide the lintel beam of a door-way. The width of this door-way, i.e. its span, is greater than the normal spacing (of e.g. 3 m) between neighbouring frames 332 and/or 332*a* and/or 332*b* since the lower parts 335 of the frames 332*b* are absent. The upper end edges of the strip-like further roofing elements are secured via tensioning devices, e.g. turnbuckles 382, to the end arch frame 332 of the building's main section 312. By tensioning these strip-like elements in their longitudinal direction (longitudinally of the building) they tend to contract laterally, i.e. in their width direction, so as to become taut and tensioned in this direction (transversely of the building) across neighbouring frames 332*a* and/or 332*b*.

The building structure 300 of FIGS. 7 and 8 is similar to the building structures 310 and 320 of FIGS. 1 to 6 but has no end section 322. Each arch frame 332 of building structure 300 is of I-section as shown in FIG. 4 but instead of being composed of mutually inclined straight portions 335 spliced to one another is of generally inverted U-shape with the transitions between its two straight vertical leg portions and its straight roof portions of smoothly arcuate shape. This arcuate shape is achieved by cutting a straight length of the extruded aluminium I-section frame profile longitudinally along its neutral axis, bending each of the two resultant T-section profiles to the requisite arcuate shape (if necessary, by cutting V-shaped cut-outs in the web portions 338), welding together the two arcuately bent T-section profiles to re-form the length as an I-section frame member of arcuate form, and splicing the ends of this frame member to straight frame members of like I-section to form the leg and roof portions of the arch frame. The ends of each arcuate frame portion are directed substantially perpendicular to one another so that the roof is generally flat, or at least with a pitch not exceeding 1 in 10.

The U-shaped arch frames 332 are retained in their fixed positions by horizontal bracing struts 325 consisting of square-section tubes. The two arch frames at each end of building structure 300 are also interconnected by inclined bracing struts 325*a* (FIG. 7), likewise consisting of square-section tubes, to provide increased rigidity for the structure.

Each end arch frame 332 is also provided with vertically disposed straight frame members of I-section as shown in FIG. 4, neighbouring frame members being interconnected by cross-bracing 325*b* (see FIG. 8) bolted to the internal flange portions 339. Deflector members 325*c*, e.g. plates of disc-like form, are mounted by screw-threaded means at intervals on the cross-bracing 325*b* whereby they may be moved longitudinally of the structure 300 to engage and tension to a bowed form strips of roofing material 330*e* forming the end wall of the structure 300.

It will be appreciated that each of the building structures 300, 310 and 320 is substantially of parallelepipedical shape having a rectangular floor plan. Moreover the building is of modular construction and can be of various dimensions depending on the form and number of the arch frames 332. However, for very wide buildings, e.g. in excess of say 18 m, the arch frames 332 may be reinforced to render them better able to accommodate with safety the bending moments due to wind forces and other loads. Such reinforcement may be provided by a truss attached to the underside of each arch frame coplanar therewith, the truss comprising a shallow, wide-angled V-shaped member from the apex of which a central stem rises to the centre of the arch frame, e.g. with the truss width to height ratio conveniently of the order of about 1.5:1, or may be provided by a tubular member extending horizontally between the sides of the arch frame and connected thereto by vertically upstanding stringer members. It is envisaged that a building width of up to at least 27 m can be provided in this way.

The arch frames 332 are all alike and integrally provided with the retainer means in the form of the continuous channels 350. In a modified arrangement, the arch frames 332 may be of standard I-beam or T-beam cross-section with a conventional flange portion 340 to which separate retainer means are bolted or welded during manufacture. These retainer means are conveniently constituted by elongate members such as the retainer members 360 of FIG. 5.

It will be appreciated from the foregoing that each of the building structures 300, 310 and 320 is preferably provided with the gaps 385 in the roof arranged as a slot centred on the roof centre line. This is considered particularly useful for hot and arid countries (e.g. in the Middle East) to provide for air flow into and from the building structure via the gaps 385, e.g. via air conditioning and/or ventilating equipment (preferably mounted on the roof such as to cover the said slot provided by gaps 385). Moreover, the relatively low height of the building structure (of the order of 6 m) not only permits erection and dismantling without a crane and just with low scaffolding, but also provides the interior air volume of the building structure to be minimised with little or no wasted air space (as occurs with steeply pitched roofs) so that any air-conditioning equipment provided can have a minimal capacity and/or be operable with minimal energy expenditure.

Where the building structure 300, 310 or 320 is to be erected in places liable to rain or snow, and no air-conditioning and/or ventilating equipment is to be provided covering the slot provided by the gaps 385, then alternative covering means for the slot should be provided. Such alternative covering means may for example comprise a covering superstructure 315 provided on top of the structure 300, 310 or 320. As apparent from FIGS. 1–3 and 7,8 herein, the superstructure 315 is provided by a bowed or generally arcuate channel-forming retainer member 390 secured by its ends centrally on top of each arch frame 332, each two neighbouring retainer members 390 receiving slidingly the beaded longitudinal edges of strips 330*c* of flexible roofing material. Each retainer member 390 is an extrusion of aluminium alloy similar to retainer member 360 of FIG. 5 and likewise providing channels having inwardly bent ends to provide a mouth or entrance of lesser width than the width of the channel thereby to retain said beaded edges. The strips 330*c* are shaped to have portions of their longitudinal beaded edges bowed outwardly (e.g. to a barrel-like shape) such that on tensioning the strips in the direction of their longitudinal dimension (i.e. transversely of the superstructure 315) they become tensioned in their width direction (i.e. longitudinally of the superstructure 315) so as to adopt a configuration that is concave to the exterior above the superstructure 315. Tensioning of the strips 330*c* in their longitudinal directions is effected by tensioning devices, for example including turnbuckles such as 382. A natural ventilation gap 395 in the vertical plane may be provided between at least one end edge of each strip 330*c* and the surface of a strip 330 beneath it. This can be achieved by providing each strip 330*c* with a length dimension less than that of each retainer member 390 and/or by providing each strip 330*c* with at least said one end edge of concave form instead of straight. Where the building structure has an end section 322, the corresponding end retainer member 390 of the superstructure 315 may retain the longer beaded edge of a generally trapezium-shaped element of flexible roofing material that is positioned between it and the roof of the end section 322, the other edges of the generally trapezium-shaped element being secured via tensioning devices (e.g. turnbuckles such as 382) to the "half-arch" frames 332*a* and/or the "partial arch" frames 332*b* of the end section 322.

Where the arch frames 332 are of I-beam cross-section, the internal flange portion 339 of each arch frame may be provided with channel-like retainer means for retaining duplicate elements of flexible material to provide a double-skin of (roofing) material for insulation purposes and/or reducing condensation. These retainer means may be provided by integrally forming the internal flange portions 339 as mirror-image formations of the external flange portions 340, or (as is preferred) by bolting or welding to each flange portion 339 during manufacture an elongate channel-forming member such as the retainer member 360 of FIG. 5.

From the foregoing it will be apparent that each of the building structures 300, 310 and 320 is assembled by first erecting the arch frames 332 in the fixed positions they are to assume in the finally assembled form of the building structure, these positions being held equally spaced by means of the struts 325 (e.g. aluminium tubes) and anchoring the arch frames 332 in these fixed positions (e.g. by anchor bolts through plates welded to the feet of the arch frames). These positions are equally spaced and fixed above ground level by the struts 325 (e.g. aluminium tubes) bolted at their ends to neighbouring arch frames 322. The strips or elements 330 of flexible roofing material are then fitted to the fixed framework (provided by the arch frames 332 and struts 325) by sliding the longitudinal beaded edges of each into and along the channels therefor provided by or associated with the arch frames 332 so that the strips or elements 330 are located beneath the struts 325 and positioned across neighbouring arch frames 332. When the strips or elements 330 are in position, they are tensioned in their longitudinal direction and, due to their predetermined shape in the unstressed state, they automatically become tensioned in their lateral (width) direction between neighbouring arch frames and adopt a configuration that is concave to the exterior of the building structure to provide a "saddle" or "gull wing" effect.

What is claimed is:

1. A building structure comprising a plurality of arch frames disposed in vertical planes extending transversely of the building structure and spaced apart longitudinally of the building structure, each frame being provided with retainer means for longitudinal beaded edges of flexible roofing material in the form of strips, characterized in that the lengths of two of said strips are in aggregate less than that required to extend continuously along a said arch frame, said two strips are slidingly received in said retainer means of a pair of neighbouring ones of said frames such that said two strips extend with their width dimensions directed longitudinally of the building structure across space between said pair of neighbouring frames and with their length dimensions directed transversely of the building structure in opposite directions away from a gap in the roof of the building structure between adjacent upper ends of said two strips, the bottom edges of said two strips remote from said gap are positionally fixed, and said two strips are tensioned in the direction of their length dimensions by adjustable tensioning means interconnecting the upper ends of said two strips and acting between said two strips in the general direction of their said length dimensions.

2. A building structure according to claim 1, characterized in that said arch frames are each of extruded I-beam or T-beam cross-section having a flange and a web, said flange integrally providing at least part of said retainer means as two continuous channels one each side of said web and extending the length of the corresponding arch frame.

3. A building structure according to claim 1, wherein said arch frames form part of a rigid self-supporting structure of which the rigidity and stability is unaffected by the tension in said strips.

4. A method of assembling a building structure, said method including the steps of:

erecting a plurality of arch frames in vertical planes extending transversely of the intended building structure and spaced apart longitudinally of the intended building structure, two neighbouring ones of said arch frames being provided with retainer means for longitudinal beaded edges of flexible roofing material in the form of strips;

sliding into and along the retainer means of said two neighbouring frames the longitudinal beaded edges of two said strips having an aggregate length less than that required to extend continuously along a said arch frame, said step of sliding being performed in a manner such that said two strips are positioned across the space between said two neighbouring arch frames with the width dimensions of said two strips directed longitudinally of the intended building structure and the length dimensions of said two strips directed transversely of the intended building structure in opposite directions away from one another and from a gap formed in the roof of the intended building structure between adjacent upper ends of said two strips;

positionally fixing the lower ends of said two strips remote from said gap;

interconnecting said upper ends by adjustable tensioning means; and operating said adjustable tensioning means to tension said two strips in the general direction of their length dimensions.

5. A method according to claim 4, wherein the said arch frames are erected as aforesaid and such as to form a rigid self-supporting stable framework, said framework is positionally fixed prior to said sliding step of the method, and said tensioning step of the method provides no contribution to the rigidity and stability of the erected positionally fixed framework.

* * * * *